US008900533B2

(12) United States Patent
Cohen

(10) Patent No.: US 8,900,533 B2
(45) Date of Patent: Dec. 2, 2014

(54) WELDED BLISTER PACK FOR TIPS

(75) Inventor: Jesse B. Cohen, San Diego, CA (US)

(73) Assignee: Molecular Bioproducts, Inc., San Diego, CA (US)

( * ) Notice: Subject to any disclaimer, the term of this patent is extended or adjusted under 35 U.S.C. 154(b) by 0 days.

(21) Appl. No.: 13/538,274

(22) Filed: Jun. 29, 2012

(65) Prior Publication Data

US 2014/0004023 A1 Jan. 2, 2014

(51) Int. Cl.
*B01L 9/00* (2006.01)
*B01L 9/06* (2006.01)

(52) U.S. Cl.
USPC ..... 422/564; 422/560; 422/569; 422/550; 422/551; 422/552; 206/557; 206/561; 206/562; 206/563; 206/564; 206/565

(58) Field of Classification Search
USPC ..... 422/564, 560, 569, 550–552; 206/557, 206/561–565, 588–590
See application file for complete search history.

(56) References Cited

U.S. PATENT DOCUMENTS 6,098,802 A * 8/2000 Asa et al. ..... 206/443
6,221,317 B1 * 4/2001 Carl ..... 422/564
6,610,252 B2 * 8/2003 Madril et al. ..... 422/501
7,690,274 B2 4/2010 Telimaa et al.
8,034,306 B1 * 10/2011 Grudzien et al. ..... 422/553

FOREIGN PATENT DOCUMENTS

WO 2012/103214 A2 8/2012

OTHER PUBLICATIONS

World Intellectual Property Organization, International Search Report, International Publication No. WO 2012/103214 A3, Date of Publication of the International Search Report is Nov. 1, 2012 (6 pages).
Diffinity Genomics, Diffinity RapidTip Sample Pack (8) for PCR Purification, retrieved from http://www.diffinitystore.com on Nov. 9, 2012 (2 pages).

* cited by examiner

*Primary Examiner* — Brian R Gordon
(74) *Attorney, Agent, or Firm* — Wood, Herrons & Evans, LLP

(57) ABSTRACT

A blister package for a plurality of pipette tips comprises a support block with a plurality of molded pockets that extends into the support block from a first wall. The plurality of pockets is configured to receive the plurality of pipette tips. At least one reservoir located within the support block at a distal end of and in fluid communication with at least one of the plurality of pockets. A closure member configured to close the plurality of pockets within the support block.

14 Claims, 5 Drawing Sheets

WELDED BLISTER PACK FOR TIPS

FIELD OF THE INVENTION

The present invention relates generally to functional pipette tips and, more particularly, to devices for storing and transporting the same.

BACKGROUND

Pipetters having a manually or automatically driven piston are configured to aspirate and dispense small volumes of fluid with relatively high accuracy. Conventionally, a disposable tip is placed onto an aspirating end of the pipetter to reduce cross-contamination of sample, reagents, and so forth by replacing the tip after each use.

More recently, tips have been provided functionality. That is, some tips include filters or membranes to filter the aspirated fluid while it is dispensed. In still other tips, the walls lining a lumen within the tip are coated with one or more functional groups or are otherwise treated to segregate dispersants, solutes, particulates, and/or functionally-active molecules from the fluid. In any case, these functionalized tips provide functions in addition to the aspiration/dispensing function performed by conventional pipette tips.

However, some of these functional tips require specific storage conditions in order to maintain the intended functionality. For instance, some functional tips may require dry atmosphere or specified percentage humidity. Other functional tips may require a solvent bath to maintain functionality or even a water bath to maintain a minimum humidity, particularly while the tips are stored within the drying environment of a refrigerator.

Additionally, the functional pipettes may require special handling to reduce contact or close proximity with other pipettes or that contain fragile elements therein (such as a ceramic filter or magnetic particles specifically arranged for an intended purpose) that may break or become dislodged at impact if dropped or if jarred by an adjacent pipette tip or tray.

As a result, there remains a need for devices to ensure the safe transport of functional pipette tips. The device should promote ease of use by providing access to the pipette tips while protecting the functionality of the tips during storage and/or shipment.

SUMMARY OF THE INVENTION

The present invention overcomes the foregoing problems and other shortcomings, drawbacks, and challenges of known conventional pipette tip packaging. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a blister package for a plurality of pipette tips comprises a support block with a plurality of molded pockets that extends into the support block from a first wall. The plurality of pockets is configured to receive the plurality of pipette tips. At least one reservoir located within the support block at a distal end of and in fluid communication with at least one of the plurality of pockets. A closure member closes the plurality of pockets within the support block.

Another embodiment of the present invention is directed to a blister package that includes a support block having a plurality of molded pockets therein. Each of the plurality of molded pockets extend into the support block from a first wall and receives a respective one of the plurality of pipette tips. A closure member, comprising a sealing strip, is configured to fluidically seal the plurality of pockets within the support block.

Still another embodiment of the present invention is directed to a pipette tip blister package that includes a plurality of pipette tips having an active antibody associated therewith and a support block. The support block includes a joined first and second pieces, each of which includes an inner surface configured to be positioned adjacent to the inner surface of the other piece and a plurality of cavities extending into the inner surface. When the first and second pieces are joined, respective ones of the pluralities of cavities form a pocket configured to support a pipette tip therein. At least one reservoir is located within the support block, at a distal end of and in fluid communication with the pockets. The reservoir includes a buffer solution therein that is configured to maintain the activity of the antibody. A closure member closes the pockets within the support block.

One embodiment of the present invention is directed to a blister package that includes a support block. A plurality of molded pockets extend from a first wall. There is a recess within the first wall such that the plurality of pockets extends into the support block from the recess. A closure member is received by the recess and configured to close the plurality of pockets.

The above and other objects and advantages of the present invention shall be made apparent from the accompanying drawings and the descriptions thereof.

BRIEF DESCRIPTION OF THE FIGURES

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION

Figure 1:
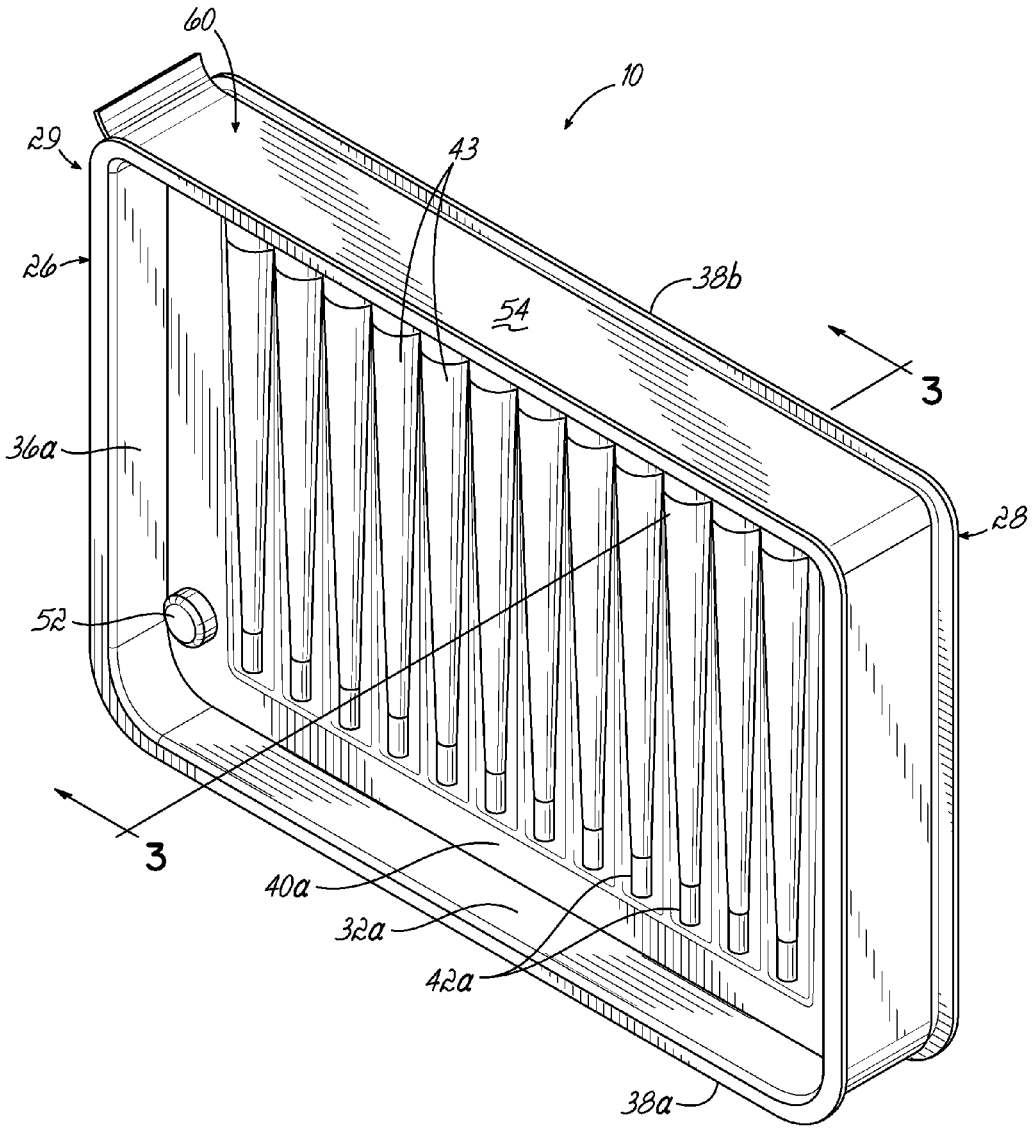
FIG. 1 is a side elevational view of a blister pack according to one embodiment of the present invention, the blister pack supporting twelve pipette tips therein.

Turning now to the figures, and in particular to FIG. 1, a blister pack 10 for supporting twelve pipette tips 12 therein is shown. Each of the pipette tips 12 may be configured to provide particular functionality requiring certain environmental conditions to maintain this functionality. Additionally or alternatively, the pipette tips 12 may include frangible structures (not shown), such as membranes, ceramic plugs, and so forth, that may be subject to fracture or breakage without additional support to limit collisions during shipment and/or storage. The pipette tips 12 generally include an elongated housing 14 that may be constructed from a molded, inert material, generally a plastic material, such as polypropylene, or a combination of suitable materials. The housing 14 has a distal end 16 that is tapered, a proximal end that is enlarged to form a hub 18 that is received by a shaft 20 (FIG. 5) of a pipetter 22 (FIG. 5), and a lumen 24 (FIG. 2) extending therebetween. Exemplary functional tips as described herein may include, for example, those described in U.S. application Ser. No. 13/438,939, filed on Apr. 4, 2012, and entitled SYRINGE FILTER, and International Application No. PCT/US12/22545, filed on Jan. 25, 2012, and entitled MAGNETIC PIPETTE TIP, the disclosure of each application incorporated herein by reference, in its entirety.

Figure 2:
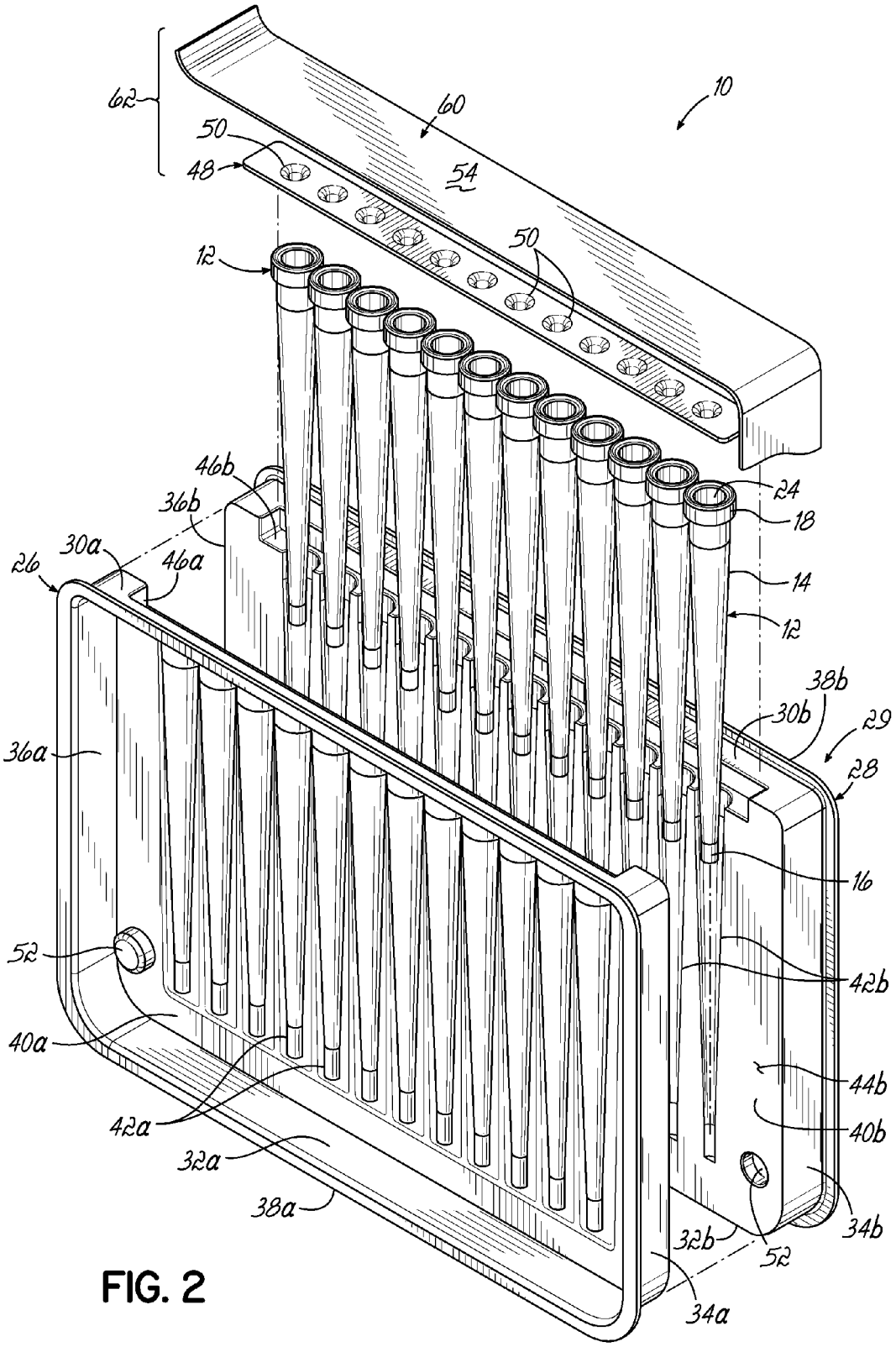
FIG. 2 is an exploded view of the blister pack of FIG. 1.

With reference now to both of FIGS. 1 and 2, the blister pack 10 may include a first, or front, piece 26 and a second, or back, piece 28 that are molded from a polymeric material, such as polyethylene terephthalate ("PETE") or other like material having an equivalent recycle code #1, to conform to and support the pipette tips 12. The front and rear pieces 26, 28 are collectively referenced as a support block 29 for the aforementioned pipette tips 12.

Each of the front and back pieces 26, 28 includes a top wall 30*a*, 30*b*, a bottom wall 32*a*, 32*b*, and two side walls 34*a*, 36*a*, 34*b*, 36*b* therebetween with a laterally-extending lip 38*a*, 38*b* surrounding the perimetric edge of the walls 30*a*, 30*b*, 32*a*, 32*b*, 34*a*, 36*a*, 34*b*, 36*b*. Molded, inner walls 40*a*, 40*b* are recessed with respect to the lips 38*a*, 38*b* and include pluralities of cavities 42*a*, 42*b* formed while molding the front and back pieces 26, 28. Respective ones of the cavities 42*a*, 42*b*, when the first and second pieces 26, 28 are joined, form a pocket 43 that is shaped and sized to receive a pipette tip 12. Accordingly, the support block 29 would include a plurality of pockets 43, formed by the joined pluralities of cavities 42*a*, 42*b*. The cavities 42*a*, 42*b* may extend outwardly from the inner walls 40*a*, 40*b* toward a plane defined by the lips 38*a*, 38*b* of the front and back pieces 26, 28 and are hollow or concaved with respect to the inner surfaces 44*a*, 44*b* of the front and back pieces 26, 28.

It would be readily appreciated from the disclosure herein that the front and back pieces 26, 28 may be molded to package any number of pipette tips, the pipette tips being various shapes and sizes. Furthermore, it would be readily appreciated that the designation of front and back pieces 26, 28 is arbitrary and for purposes of discussion herein. In fact, envisaged embodiments may have a single mold such that two pieces resulting from the same mold may be used as front and back pieces 26, 28. Further still, and although not specifically shown, it would be readily appreciated that the blister packet 10 may be molded as a unitary structure.

The front and back pieces 26, 28 of the blister pack 10 may be joined together, with the inner surfaces 44*a*, 44*b* proximately positioned and facing one another, by one or more joining techniques, including for example, ultrasonic welding, epoxy, and polymeric cements. If desired, one or more bubbles 50 or indicia may be provided to ensure proper alignment of the front piece 26 with the back piece 28 during the joining process.

Figure 3:
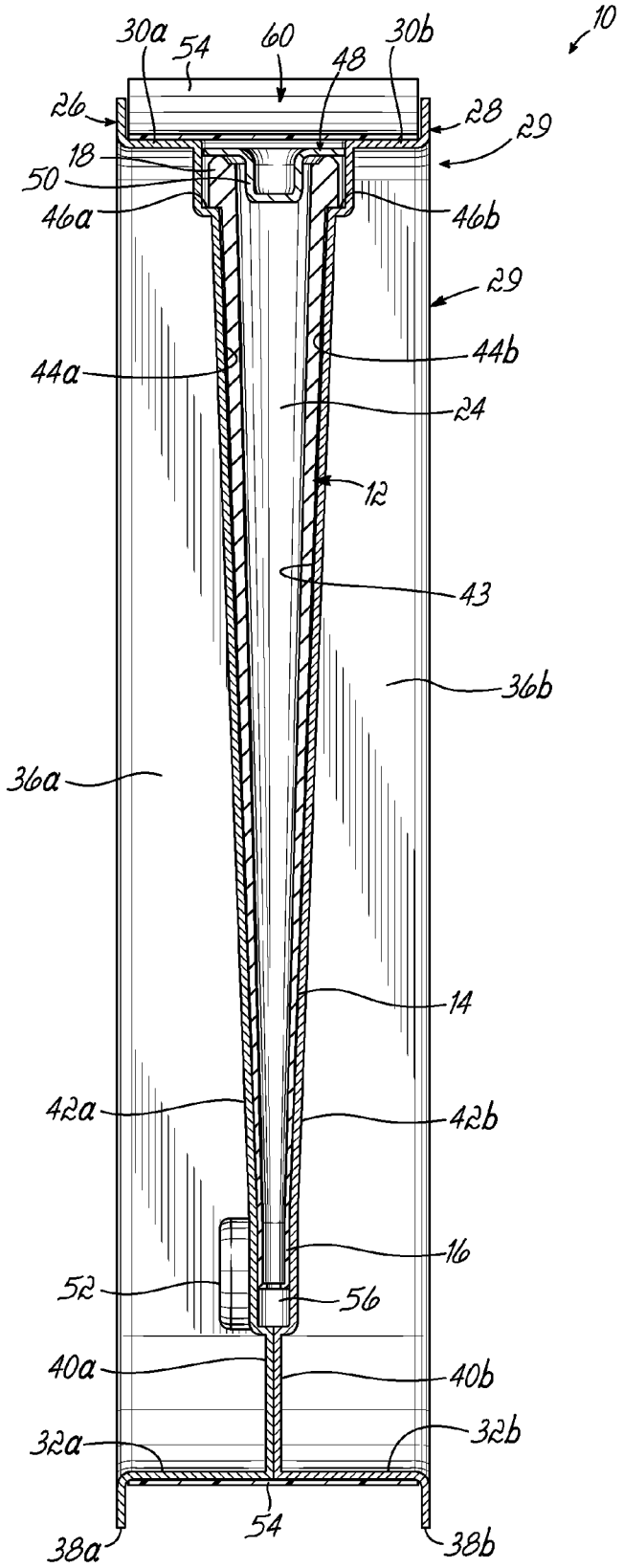
FIG. 3 is a cross-sectional view through one pipette tip and the blister pack, taken along the line 3-3 in FIG. 1.

With reference now to FIG. 3, additional features of the present invention in accordance with one embodiment thereof are shown. In particular, and with the cavities 42*a*, 42*b* forming a pocket 43 that surrounds the pipette tip 12, the pocket 43 further includes a reservoir 56 positioned so as to reside below the distal end 16 of the tip 12 and configured to receive one or more liquids necessary to maintain functionality of the tip 12. For example, the MSIA pipette tips, commercially available from Intrinsic Bioprobes, Inc. (Tempe, Ariz.), a part of Thermo Fisher Scientific (Waltham, Mass.), contain an active antibody, which allows enrichment and concentration of target proteins to picogram amounts. However, to maintain function of the active antibody, the pipette tip must be stored within a sealed container of buffer solution. Accordingly, the reservoir 56 may provide a volume of buffer solution, which protects the functionality of the pipette tip. The reservoir 56 is not limited to use with buffer solutions, but may instead also include agents for controlling a humidity level, a pH, a salt content, and so forth. However, it would be readily appreciated by those of ordinary skill in the art, and from the disclosure as provided herein, that unless such conditions of wet chemistry are required for the functionality of the pipette tips 12, the pockets 43 may be formed without reservoirs 56 or the reservoirs 56 may remain empty. While not specifically shown, the reservoir 56 may be fluidically connected such that two or more pockets 43 share a common reservoir 56.

It would be understood, from the disclosure and teachings provided herein, the reservoir 56 may be formed as an extension of the pocket 43 and does not include residual volume of conventional packages of which the pipette tip does not expand or extend the full length of the pocket. For example, in one embodiment, each reservoir 56 extends from a tapered distal end of a respective pocket 43, with the reservoir 56 having a generally constant diameter along its length.

Further to the use of fluids to protect pipette tip functionality, the blister pack 10 further includes a closure member 60, specifically shown in one embodiment as a sealing strip 62 that is configured to fluidically seal the plurality of pipette tips 12 within the support block 29. In illustrative embodiment of FIGS. 2 and 3, the sealing strip 62 includes a cover strip 48 and an adhesive strip 54. The cover strip 48, like the front and back pieces 26, 28 of the blister pack 10, may be molded from a polymeric material and include a plurality of dimples 50 corresponding to the plurality of pipette tips 12 stowed within the blister pack 10. The dimples 50 extend at least partially, into the hub 18 and lumen 24 of the pipette tips 12. Primarily, the cover strip 48 may be used for aligning the sealing strip 62 with the plurality of pipette tips 12.

The adhesive strip 54 then forms the fluid-tight seal between the cover strip 48 and the support block 29. The adhesive strip 54, one example of which being vinyl tape, may be applied to and extend around the support block 29, including the top, bottom, and side walls 30*a*, 30*b*, 32*a*, 32*b*, 34*a*, 36*a*, 34*b*, 36*b* and between the lips 38*a*, 38*b*. While various adhesives may be used, vinyl tape provides the benefit of being highly conformable and easily and cleanly removable without leaving residue that retains or is itself, contaminants. The adhesive strip 54 may be used in a manner similar to a hinge in that the adhesive strip 54 with the cover strip 48 may be removed from the plurality of pipette tips 12 but remain operably coupled to the support block 29 via adhesive strip 54 attached to the side walls 34*a*, 36*a*, 34*b*, 36*b*.

In other embodiments of the present invention, although not specifically illustrated herein, one of the front and back pieces 26, 28 may include a closure member 60 that is a molded and hinged cover. The hinged cover may then be configured to move between a sealed position, in which the hinged cover resides over the plurality of pipette tips and forms a fluid-tight seal with the support block 29, and a vented position, in which the hinged cover is rotated away from the plurality of pipette tips.

In still other embodiments of the present invention, each of the top walls 30*a*, 30*b* of the front and back pieces 26, 28 may include a shelf 46*a*, 46*b* such that when the inner surfaces 44*a*, 44*b* are positioned together, the shelves 46*a*, 46*b* form a recess that is in communication with each of the pockets 43. The recess 46*a*, 46*b* is configured to receive the cover strip 48 such that the cover strip 48 is flush with the top walls 30*a*, 30*b*.

As result of the sealing strip 62 (for example, the cover strip 48 and the adhesive strip 54) the blister package 10 is suitable for storage under ambient environment or under refrigeration, for example, down to about 4° C., without the pipette tip 12 being subject to drying out or contamination.

Figure 4:
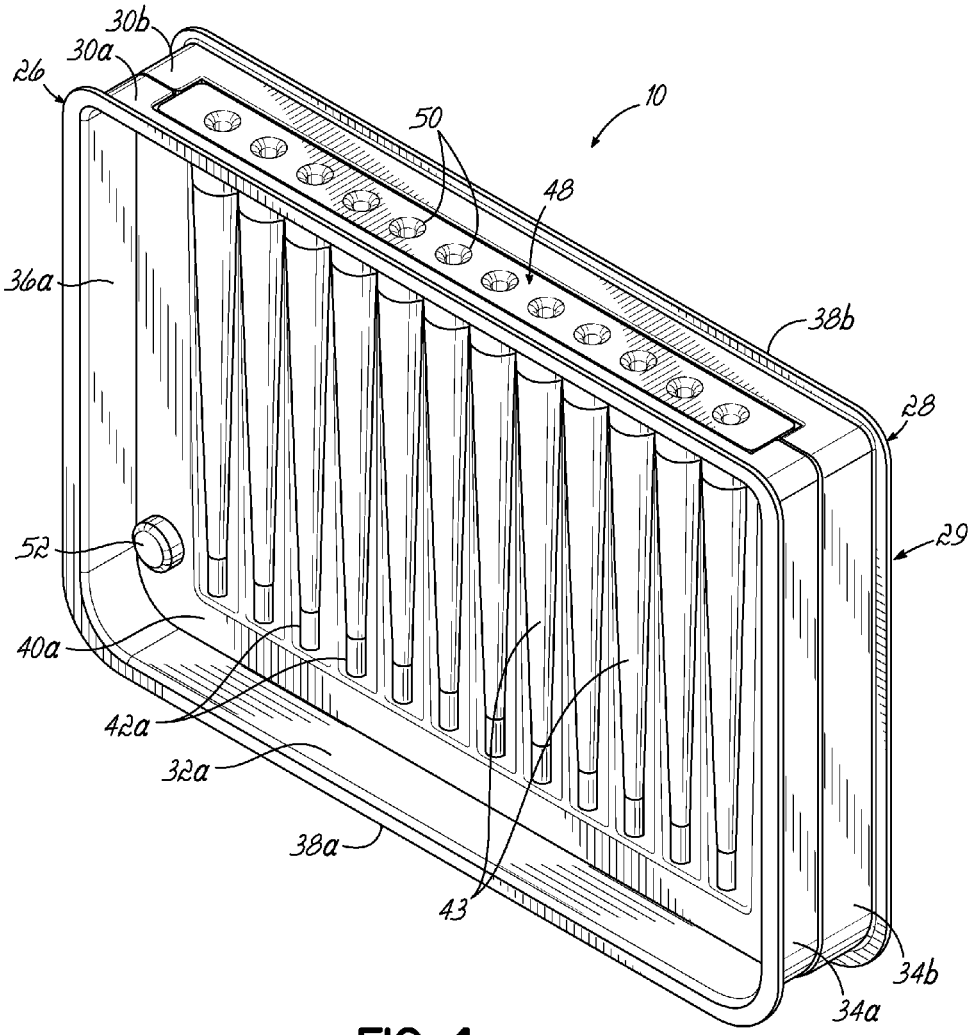
FIG. 4 is a side elevational view similar to FIG. 1 but with the adhesive strip removed.
Figure 5:
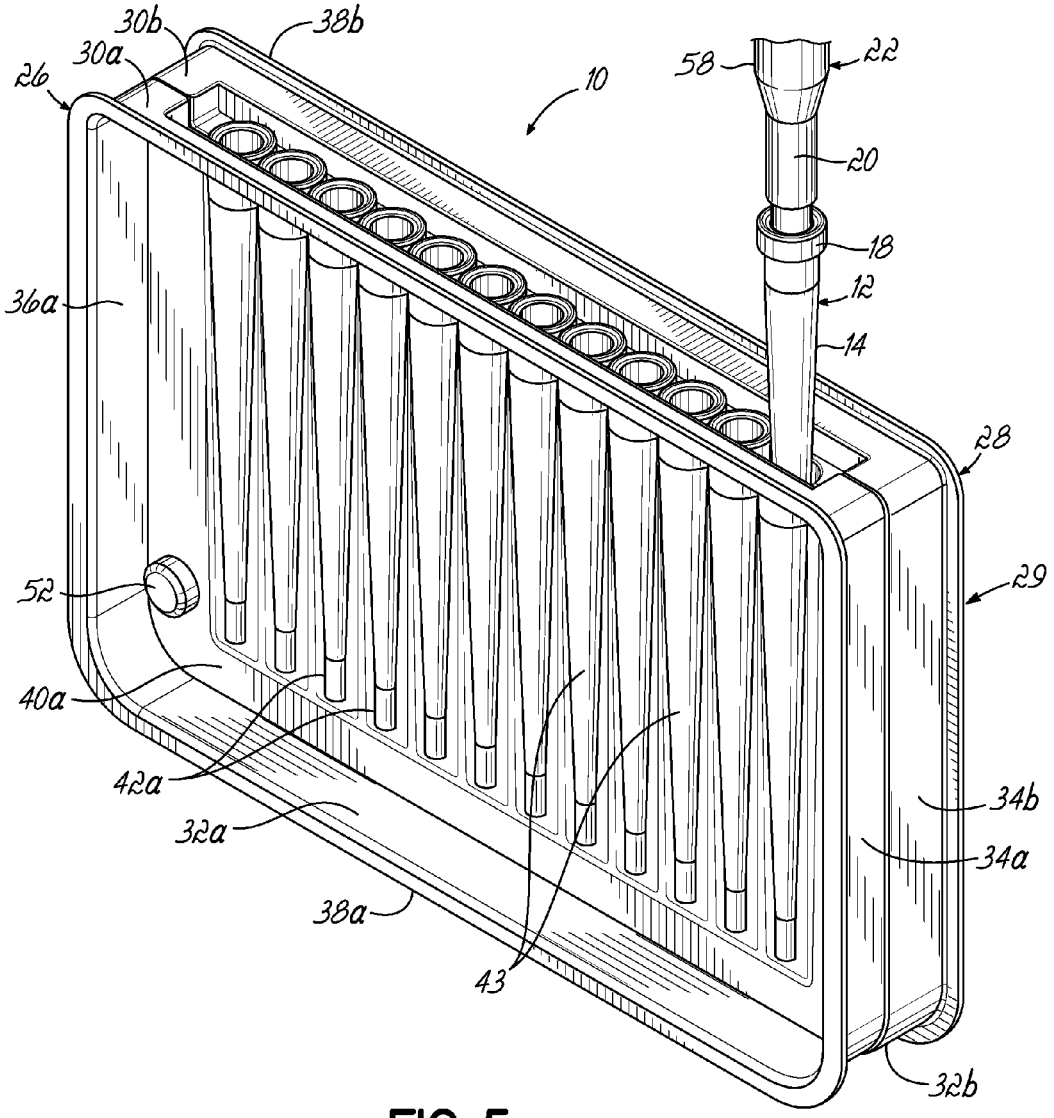
FIG. 5 is a side elevational view similar to FIG. 4 but with the cover strip removed and with a pipette tip removed via a pipetter.

In use, and with reference now to FIGS. 4 and 5, after the adhesive strip 54 and the cover strip 48 are removed, the pipetter 22 may be used to remove at least one pipette tip 12 from the blister package 10 in accordance with any one embodiment of the present invention; however, the present invention should not be limited to use with the particular pipetter shown. One exemplary pipetter is described in detail in U.S. Pat. No. 7,690,274, entitled "PIPETTE WITH A TIP REMOVING MECHANISM," issued to Thermo Fisher Scientific (Vantaa, Finland) on Apr. 6, 2010, the disclosure of which is incorporated herein by reference in its entirety. Generally, the pipetter 22 includes a housing 58 from which the shaft 20 extends. Although not shown, the housing 58 may further include a finger rest and an activator, such as a plunger, operably associated with the aspirating mechanism (not shown) located within the housing 58. The housing 58 may also include a tip removal mechanism (not shown). Further details of the aspirating mechanism and the tip removal mechanism are provided in the incorporated disclosure. In any event, the blister package 10, as provided herein, provides sufficient structural support to the tip to support insertion of the shaft 20 into the hub 18 of the pipette 12.

In other embodiments of the present invention, although not specifically shown herein, a multi-channel pipetter may be used rather than a single channel pipetter, as shown. In that regard, multi-channel pipetters may include two-channels or more, but more typically will be no greater than the number of tips provided within the blister package. To facilitate use with multi-channel pipetters, the tips may be constructed or molded with a spacing that is in accordance with the Society for Biomolecular Standards ("SBS") and/or with dimensions that are customary to multi-channel pipetters and/or robotic systems, for example, 9 mm multi-pipette nose spacing.

While the present invention has been illustrated by description of various embodiments, and while those embodiments have been described in some detail, they are not intended to restrict or in any way limit the scope of the disclosed invention. Additional advantages and modifications will readily appear to those skilled in the art. The various features of the present invention may be used alone or in any combination depending on the needs and preferences of the user. This has been a description of the present invention, along with methods of practicing the present invention as currently known.

What is claimed is:

1. A blister package for pipette tips comprising:

a support block comprising joined first and second pieces, each of the first and second pieces comprising:

an inner surface configured to be positioned adjacent to and facing the inner surface of the other piece;

a plurality of cavities extending into the inner surface such that when the first and second pieces are positioned adjacent to and facing one another, corresponding ones of the plurality of cavities form a pocket extending into the support block from a first wall and being configured to support a pipette tip therein, with each respective pocket having a tapered distal end;

a plurality of reservoirs located within the support block and each being formed as an extension of a respective pocket at the tapered distal end of the pocket and in fluid communication therewith;

a closure member configured to close the plurality of pockets within the support block.

2. The blister package of claim 1, wherein the closure member is a sealing strip configured to fluidically seal the plurality of pockets within the support block.

3. The blister package of claim 1, wherein the support block includes first and second pieces joined by at least one of an ultrasonic weld, an epoxy, a polymeric cement, or a combination thereof.

4. The blister package of claim 1, wherein the closure member comprises a sealing strip including a cover strip and an adhesive strip, the cover strip including a plurality of dimples formed therein configured to align the sealing strip with hubs of the plurality of pipette tips and the adhesive strip being configured to seal the cover strip with the support block.

5. The blister package of claim 4, further comprising:

a recess within the first wall configured to receive the cover strip.

6. The blister package of claim 1, wherein the at least one reservoir includes a plurality of reservoirs, each of the plurality of reservoirs being in fluid communication with a respective one of the plurality of pockets.

7. A blister package for pipette tips comprising:

a support block comprising joined first and second pieces, each of the first and second pieces comprising:

an inner surface configured to be positioned adjacent to and facing the inner surface of the other piece;

a plurality of cavities extending into the inner surface such that when the first and second pieces are positioned adjacent to and facing one another, corresponding ones of the plurality of cavities form a pocket extending into the support block from a first wall and being configured to support a pipette tip therein, with each respective pocket having a tapered distal end; and a closure member comprising a sealing strip configured to fluidically seal the plurality of pockets within the support block, wherein the sealing strip includes a cover strip and an adhesive strip, the cover strip including a plurality of dimples formed therein configured to align the sealing strip with hubs of the plurality of pipette tips and the adhesive strip being configured to seal the cover strip with the support block.

8. The blister package of claim 7, further comprising:

at least one reservoir located within the support block at a distal end of and in fluid communication with at least one of the plurality of pockets.

9. The blister package of claim 7, further comprising:

a recess within the first wall configured to receive the closure member.

10. A pipette tip blister packaging system comprising:

a plurality of pipette tips, each of the plurality of pipette tips including an active antibody for a selected function;

a support block comprising joined first and second pieces, each of the first and second pieces comprising:

an inner surface configured to be positioned adjacent to and facing the inner surface of the other piece;

a plurality of cavities extending into the inner surface such that when the first and second pieces are positioned adjacent to and facing one another, corresponding ones of the plurality of cavities form a pocket configured to support a pipette tip therein;

at least one reservoir located within the support block at a distal end of and in fluid communication with pockets;

a buffer solution within the at least one reservoir, the buffer solution configured to maintain the activity of the antibody; and a closure member configured to close the plurality of pipette tips and the pockets within the support block.

11. The blister package of claim 10, wherein the closure member is a sealing strip having a cover strip and an adhesive strip, the cover strip being configured to align the sealing strip with hubs of the plurality of pipette tips and the adhesive strip being configured to seal the cover strip with the support block.

12. A blister package for pipette tips comprising:

a support block comprising joined first and second pieces, each of the first and second pieces comprising:

an inner surface configured to be positioned adjacent to and facing the inner surface of the other piece;

a plurality of cavities extending into the inner surface such that when the first and second pieces are positioned adjacent to and facing one another, corresponding ones of the plurality of cavities form a pocket extending into the support block from a first wall and being configured to support a pipette tip therein, with each respective pocket having a tapered distal end;

a recess within the first wall such that the plurality of pockets extends into the support block from the recess; and a closure member configured to be received by the recess and close the plurality of pockets within the support block.

13. The blister package of claim 12, wherein the closure member comprises a sealing strip having a cover strip and an adhesive strip, the cover strip including a plurality of dimples formed therein configured to align the sealing strip with hubs of the plurality of pipette tips and the adhesive strip being configured to seal the cover strip with the support block.

14. The blister package of claim 12, further comprising:

at least one reservoir located within the support block at a distal end of and in fluid communication with at least one of the plurality of pockets.

* * * * *